United States Patent [19]

Sassella et al.

[11] Patent Number: 4,877,227

[45] Date of Patent: Oct. 31, 1989

[54] APPARATUS FOR MACHINING A WORK PIECE AND A JIG ASSEMBLY FOR HOLDING THE WORK PIECE

[75] Inventors: Christopher D. Sassella, Melbourne; John R. Whitney, MacLeod; Harold K. McGeehan, Pascoe Vale, all of Australia

[73] Assignee: Dowell Australia Ltd., Victoria, Australia

[21] Appl. No.: 67,884

[22] Filed: Jun. 30, 1987

[30] Foreign Application Priority Data

Jun. 30, 1986 [AU] Australia ..... PH6657

[51] Int. Cl.[4] ..... B25B 1/20

[52] U.S. Cl. ..... 269/43; 269/236; 269/270

[58] Field of Search ..... 269/37, 40–45, 269/152–156, 268–270, 236; 81/426, 426.5; 254/18–23

[56] References Cited

U.S. PATENT DOCUMENTS

| | | | |
|---|---|---|---|
| 942,549 | 12/1909 | Cronk | 81/426.5 |
| 1,235,986 | 8/1917 | McLeod | 254/23 |
| 1,293,696 | 2/1919 | Bush | 81/426.5 |
| 1,506,675 | 8/1924 | Seppmann | 81/426.5 |
| 2,082,653 | 6/1937 | Rawson | 269/270 |
| 2,366,897 | 1/1945 | Soutar | 269/270 |
| 2,612,821 | 10/1952 | Skay | 269/153 |
| 2,934,983 | 5/1960 | Daggitt | 81/426.5 |
| 3,162,939 | 12/1964 | Wendell . | |
| 3,202,023 | 8/1965 | Parker | 269/270 |
| 4,505,011 | 3/1985 | Dupuy | 269/156 |
| 4,691,905 | 9/1987 | Tamura et al. | 269/45 |

FOREIGN PATENT DOCUMENTS

| | | | |
|---|---|---|---|
| 24739 | 6/1909 | United Kingdom | 81/426.5 |

*Primary Examiner*—Robert C. Watson

*Attorney, Agent, or Firm*—Foley & Lardner, Schwartz, Jeffery, Schwaab, Mack, Blumenthal & Evans

[57] ABSTRACT

A set of jaw pieces comprising at least two separate jaw pieces for use in a vice arrangement is provided in which the individual jaw pieces can move between a release position in which a work piece may be selectively inserted or removed and an operative position in which the work piece is securely held between at least two of the jaw pieces, each of the jaw pieces is provided with a flange or groove for interlocking with a complementary flange or groove of another jaw piece to facilitate relative movement of the jaw pieces when moving between the release and operative positions and each of the jaw pieces is provided with a relatively involutedly shaped portion such that when a shaped work piece having a similar involutedly shaped profile is placed between the opposing involutedly shaped jaw portions the work piece is securely held in such a manner that it may be machined without substantially damaging or distorting the work piece. Additionally, there is provided a jig arrangement for holding the jaw pieces to form a vice arrangement and a method of using the jaw pieces, vice arrangement and jig arrangement is described.

12 Claims, 4 Drawing Sheets

APPARATUS FOR MACHINING A WORK PIECE AND A JIG ASSEMBLY FOR HOLDING THE WORK PIECE

The present invention relates to a method and apparatus for machining a work piece and to a jig assembly for holding the work piece while it is being machined, and in particular to a method of cutting and holding metal work pieces in a vice arrangement of the assembly. Even more particularly the present invention relates to a jig assembly having a set of holding jaws, to the set of holding jaws themselves and to the use of such jaws and the jig assembly to cut and profile extruded aluminium sections.

Although the present invention will be described with particular reference to a jig assembly having a specific set of jaws made from aluminium for cutting and profiling extruded sections of aluminium to certain preselected lengths and profiles for use in a particular application, such as for example in the manufacture of a window, door, shower enclosure or the like, it is to be noted that the present invention is not so limited and is more extensive in scope including other means of holding the metal extrusions and to the use of the jig and jaws in other applications.

The present invention finds particular application in the manufacture of doors, windows, shower screens and the like from extruded aluminium sections. A length of aluminium extrusion of the required profile must be cut accurately to length. However because of the somewhat complicated shapes of the sections being used, a simple straight cut through the entire section is no longer sufficient to make a clean join. In fact the end of a single section may have to undergo quite a variety of operations to achieve the precise end and side profile required. Furthermore not all operations involve the total thickness of the shape of the profile, a part only of the profile requiring machining or cutting. Thus, the end of a section not only requires cutting to length but also requires additional operations to produce the exact shape that will matingly join with other parts of the door, window or whatever. It is not easy to produce this exact end profile without damaging or distorting the extruded section due to the relatively low strength of the aluminium extruded sections and the strength imparted to some of the profiles due to the shape and thickness. Thus in many operations the extruded section may be bent, distorted or otherwise damaged.

One problem encountered when making a framework from separate aluminium pieces is to be able to quickly and accurately cut and profile all of the differently shaped extruded sections to their respective desired lengths and profiles so that each section retains its exact extruded shape without being distorted during the machining operation in order that the finished sections may be assembled together to form an accurately fitting framework without unsightly gaps showing or the framework being weakened because the profiled sections mismatch. One way of cutting the sections without distortion is to clamp the sections in a set of jaws having the exact complementary profile to that of the sections so that the sections can be held fast in the jaws while being cut to prevent them distorting. However, for each different profile of the aluminium extruded section, a jaw having the exact complementary shape is required. Thus, quite a large number of differently shaped jaws are required to be stocked and used to match the large number of differently profiled sections which involves a large expense. Furthermore, it is time consuming to change from one shaped jaw to another shaped jaw very time the profile section being cut is changed. Therefore it is one aim of the present invention to provide a set of jaws having a plurality of separate profiles that are adapted or capable of receiving a plurality of differently profiled sections without the need to stock a large number of differently shaped individual jaws or without the need to keep exchanging the jaws each time the profile changes.

Another aim of the present invention is to provide a jig assembly suitable for use in cutting and profiling sections having a set of interchangeable jaws that may be quickly and conveniently replaced when changing from one job to the next wherein each set of interchangeable jaws has a plurality of different profiles.

One problem of using specifically shaped jaws for a particular purpose is that the jaws need to be specifically designed for their unique job and made from a hardened material which is resistant to damage occasioned by repeated use. Such jaws are usually either made from a solid piece of metal usually hardened steel or fabricated from many individual pieces of metal and subsequently joined together to form the jaw profiles. Such jaws are expensive to manufacture since they are made from materials which are expensive to purchase and also from materials which require very accurate and precise machining and working generally which is labour intensive and further adds to their cost of manufacture. Therefore, it is one aim of the present invention to provide a set of jaws which may be extruded form a suitable metal, such as for example from aluminium or aluminium alloy, in continuous lengths and cut to size thereby reducing the cost of and the time for making the set of jaws.

According to one aspect of the present invention there is provided a set of jaws comprising at least a first jaw piece and a second jaw piece, said jaw pieces being movable between an operative position for securely holding a work piece therebetween in use and a release position in which the jaw pieces are disengaged from each other to allow insertion and withdrawal of a work piece therebetween in use, said first jaw piece having a first portion for cooperatively engaging with a first portion of said second jaw piece to facilitate engagement of the jaw pieces together into the operative position when moved in one direction and to facilitate spacing of the jaw pieces apart from each other to adopt the release position when moved in a second direction, said first and second jaw pieces each having respective second portions which cooperate with each other to securely hold the work piece when the jaw pieces are in the operative position, said second portion of said first jaw piece having a profile which is complementary to a first portion of the work piece and said second portion of said second jaw piece having a profile which is complementary to a second portion of the work piece, said second portions when in the operative position defining a space therebetween corresponding to the profile of the work piece.

According to another aspect of the present invention there is provided a set of jaws comprising two or more jaw pieces substantially as herein described and/or defined wherein each jaw piece is formed as an extrusion from aluminium or an aluminium-containing alloy which is capable of being extruded.

According to another aspect of the present invention there is provided a jig assembly having a set of jaws comprising two or more jaw pieces substantially as herein described and/or defined, wherein at least one of the set of jaw pieces further comprises a third portion for cooperatively engaging with respective portions of a movable vice means wherein said first portions of said respective jaw pieces cooperatively engage with each other into said operative position in response to movement of said movable vice means in one direction and said jaw pieces cooperatively move apart from each other into a release position in response to movement of said movable vice means in the opposite direction.

According to a further aspect of the present invention there is provided a method of machining a work piece comprising inserting a profiled work piece between a first portion of a first jaw piece and a first portion of a second jaw piece and moving said respective first portions towards one another into an operative position to hold said work piece securely therebetween, said first potion of said first jaw piece having a profile complementary to the profile of a first portion of the work piece and said first portion of said second jaw piece having a profile complementary to the profile of a second portion of the work piece, said jaw pieces when in the operative position defining a space between the first portions corresponding to the shape of the profile of the work piece, said work piece when held between the jaw pieces extending beyond the extremities of the jaw piece in use such that the projecting portion of the work piece may be selectively machined substantially without distortion or damage in use.

Typically, the set of jaws comprises a multitude or plurality of jaw pieces, such as for example 2, 3, 4, 5, 6 or more separate pieces. More typically, the set of jaws comprises at least two of the jaws forming a pair of substantially identical jaw pieces. Typically, there are two or three pairs of substantially identical jaw pieces. Preferably, there are 5 separate jaw pieces comprising a first pair of identical jaw pieces, a second pair of identical jaw pieces of different shape to the first pair and a fifth jaw piece different in shape from the first and second pairs.

Even more typically, the pairs of jaw pieces are arranged as mirror images about a central axis, preferably one pair of the jaw pieces being arranged to abut together along the central axis whereas another of the pairs is arranged so as to be located at spaced apart locations which are equidistant from the central axis on either side of the central axis. Typically, the fifth jaw piece is centrally located about the central axis of the jaw set.

Typically, all five jaw pieces are arranged interlockingly with respect to each other so that each jaw piece interlockingly engages with at least one other jaw piece.

Typically, the profiled portion of the jaw pieces are surface hardened such as by anodising, and the like so that the profile of the jaws are protected against wear.

Additionally, the jaw pieces may be surface treated so as to provide a non-marking surface for the work pieces, such as for example inserts may be provided at strategic locations to cushion or otherwise protect the work piece while providing reproducibility.

Typically, the machining operations that may be accomplished by using the jaw pieces of the present invention include operations such as pressing, punching, cutting, such as with knife cutters, mortising, milling, profiling, routing, sawing or the like including both machining and hand working of the work piece.

Typically, each jaw piece has a plurality of profiled portions and are arranged with others of the jaw pieces to define a plurality of gaps of differently shaped profiles so that the work piece may be inserted between them in a plurality of different orientations which correspond to the plurality of operations to be performed on the work piece. Typically, the jig assembly may comprise a number of jigs located at spaced apart locations so that different machining operations may be performed on the work piece at different locations simultaneously. Typically, the plurality of jigs of the jig assembly may be arranged so that the same operation is performed on a plurality of work pieces simultaneously in the manner of an assembly line.

Typically the machining of the work piece when inserted between the jaw pieces occurs very close to the jaw pieces since the machining tool is located contiguously with the jaw pieces to further enhance the machining of the work piece without damage or distortion.

Typically, the jaw pieces are provided with locating means such as dowels and the like to accurately locate the respective jaw pieces with respect to each other. Typically, the jaw pieces are provided with resilient biasing means to facilitate spacing of the jaw pieces apart from each other. Typically, the biasing means are compression springs or the like. Typically, the resilient biasing means and the locating means are arranged in parallel relationship to each other and perpendicularly to the sides of the respective jaw pieces to prevent any turning movement or couple being applied to the jaw pieces when separating.

The present invention will now be described by way of example with reference to the accompanying drawings in which.

Figure 1:
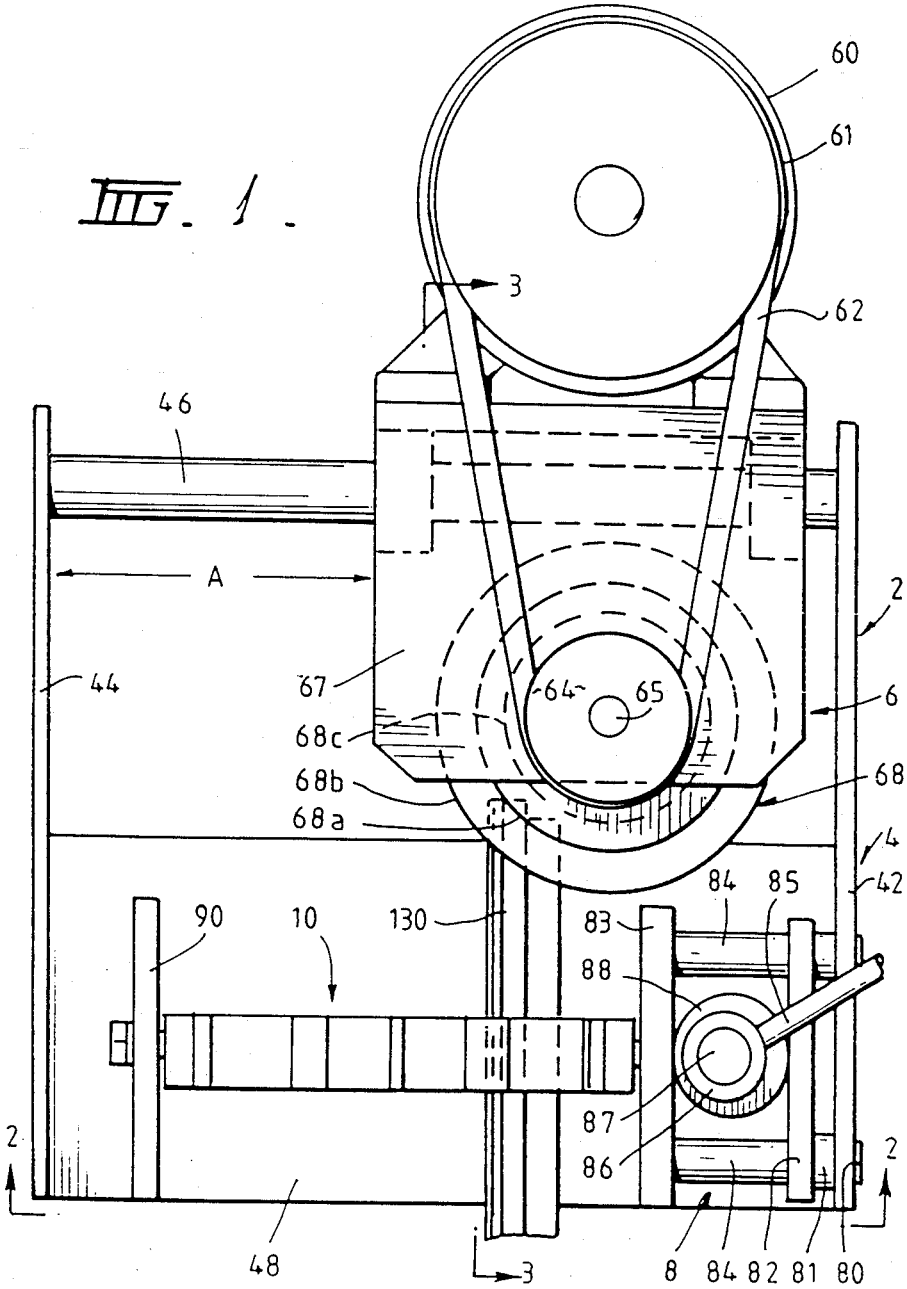
FIG. 1 is a plan view of one form of the machining jig assembly made in accordance with the present invention showing a particular specific set of jaws locked in a clamping position around an aluminium extrusion.

It is to be noted that in the following description of one embodiment of the present invention the terms used, such as for example, up, upper, lower, side and like refer to the jig assembly and the jaw pieces in their normal, in use, operating position.

In the drawings there is shown a jig assembly generally denoted as 2 comprising a framework assembly generally denoted as 4, a machining assembly generally denoted as 6, a vice assembly generally denoted as 8 and a jaw assembly generally denoted as 10. Very briefly in use, the machining assembly 6 moves from side to side as shown by arrow A so that the rotating cutting elements 68 cut the aluminium extrusion 130 located in the jaw assembly 10.

Framework assembly 4 comprises a pair of generally parallel rectangular opposed side plates 42, 44 spaced apart from each other and interconnected at their respective one ends by a pair of generally spaced apart tubular solid guide bars 46 and at their respective other ends by a substantially rectangular flat base plate 48 located so as to interconnect the respective lower edges of plates 42, 44 at the other end. Plate 48 forms a base for mounting the vice assembly 8 and jaws 10 upon.

Figure 3:
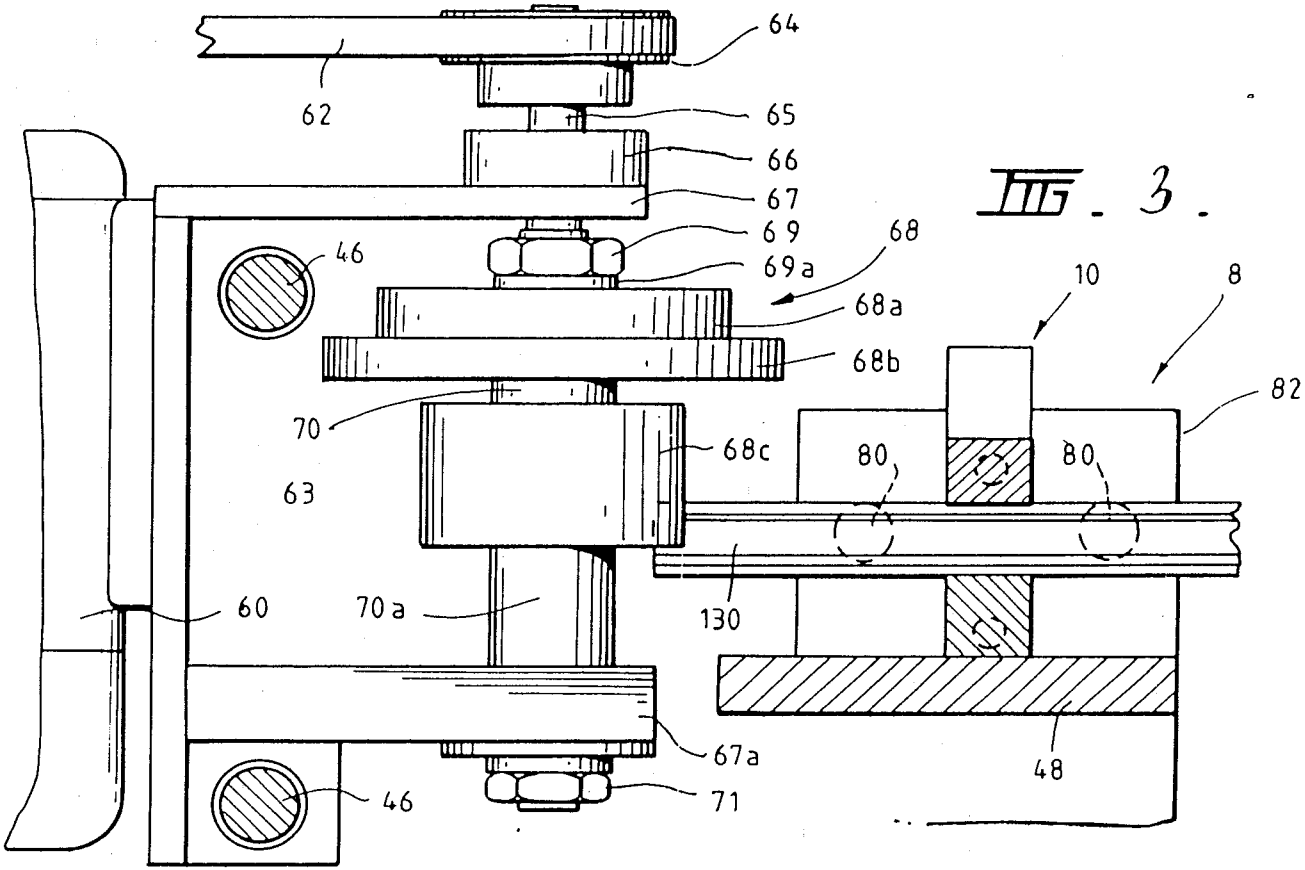
FIG. 3 is a side view of the jig assembly of FIG. 1 along the line 3 to 3 of FIG. 1 showing the machining jig assembly having a set of rotary cutters from cutting the aluminium extrusion to length.

Machining assembly 6 is mounted on guide bars 46 for sideways movement between plates 42,44 along the lengthwise extending axis of guide bars 46 as shown by arrow A of FIG. 1. Machining assembly 6 comprises a driving motor 60 having a pulley wheel 61 around which is located a pulley belt 62 driving a rotary cutter assembly 63. Rotary cutter assembly 63 which is shown in more detail in FIG. 3, comprises a pulley 64 around which pulley belt 62 is located, a driving shaft 65 for rotating with bearing or bushing 66 fixedly located to upper support bracket 67. The other end of shaft 65 is securely connected to lower support bracket **67*a* by suitable fastening means, such as nut and washer combination 71** and is provided with a suitable bearing.

The following machining elements are located in order on shaft 65 between upper support bracket 67 and lower support bracket **67*a*. Adjacent support 67 is lock nut 69, then washer 69*a* followed by the first cutter 68*a*, second cutter 68*b*, spacer 70, third cutter 68*c* and second spacer 70*a* which is located adjacent lower support bracket 67*a*. Lock nut 69 serves to lock the cutters and spacers securely in place on the shaft 65 at the desired location. Any suitable form of cutting wheel or cutters 68 may be used such as for example a rotary cutter having a plurality of cutting teeth radially arranged around the hub of the cutter. Any combination of cutters and spacers may be located on shaft 65** so as to permit machining of the exact profile desired in the aluminium extrusions when clamped in the jaw assembly depending on the exact end product being formed by the extrusion.

In use, motor 60 is activated to drive pulley wheel 61 and pulley belt 62 which in turn drives pulley wheel 64, shaft 65 and the rotary cutter assembly 63 all in corresponding rotation. As the machine assembly 6 is moved along guide bars 46 past the end of aluminium extrusion 130, the unwanted portion of the end of the aluminium extrusion is removed.

Vice assembly 8 comprises two parallel spaced apart tubular support bars 80 having their respective one ends fixedly connected to side plate 42 by suitable fastening means. Support bars 80 are for carrying slidable clamping arrangement thereon to slide to and away from side plate 42 in use so as to clamp and release jaw assembly 10. A spacer 81 is provided over each of the bars 80 to space the slidable clamping arrangement away from plate 42.

The slidable clamping arrangement comprises a first relatively larger plate 83 and a second relatively small plate 82 spaced apart from each other in parallel relationship and both parallel to plates 42, 44. A pair of hollow tubular collars 84 interconnect the respective one ends of the two plates 82, 83 to form a substantially rectangular assembly having an open centre. The clamping arrangement slides as one in union on the pair of support bars 80 and its movement is effect by a rotatably actuating assembly located internally within the open centre of the rectangular assembly. The actuating assembly comprises handle 85 which is connected at its proximal end to ring 86 which is located over shaft 87 at its top end. An eccentric cam 88 is provided around shaft 87 intermediate ring 86 and base plate 48. The actuating assembly is fixed to base plate 48 by a suitable fastening means 89 which secures the actuating assembly in place while allowing it to rotate to thereby effect actuation of the vice assembly. In use, handle 86 is rotated by an operator which in turn causes shaft 87 and cam 88 to rotate. Since cam 88 is in contact with the inner surfaces of both plates 82, 83 simultaneously at all times because the two plates are maintained at a fixed spaced apart distance at all times, as cam 88 rotates the position of the slidable clamping arrangement relative to the base plate 48 changes as plates 82, 83 are both forced to move simultaneously by the action of the eccentric cam 88 pushing against them. As cam 88 rotates in one direction, typically the clockwise direction, the clamping arrangement moves towards the jaw assembly 10 to clamp the jaws whereas as cam 88 rotates in the opposite direction, the clamping arrangement moves towards side plate 42 to release the jaw assembly 10. A fixed plate 90 is fixedly connected to base plate 48 on the other side of the jaw assembly 10. The jaw assembly 10 is located between plates 83 and 90. As the actuating assembly is moved as described above the plate 83 is pushed towards plate 90 so as to clamp the jaw assembly 10 therebetween whereas when cam 88 is rotated in the opposite direction plate 83 is moved away from plate 90 thus allowing the jaw assembly to loosen and the jaws to separate.

Figure 2:
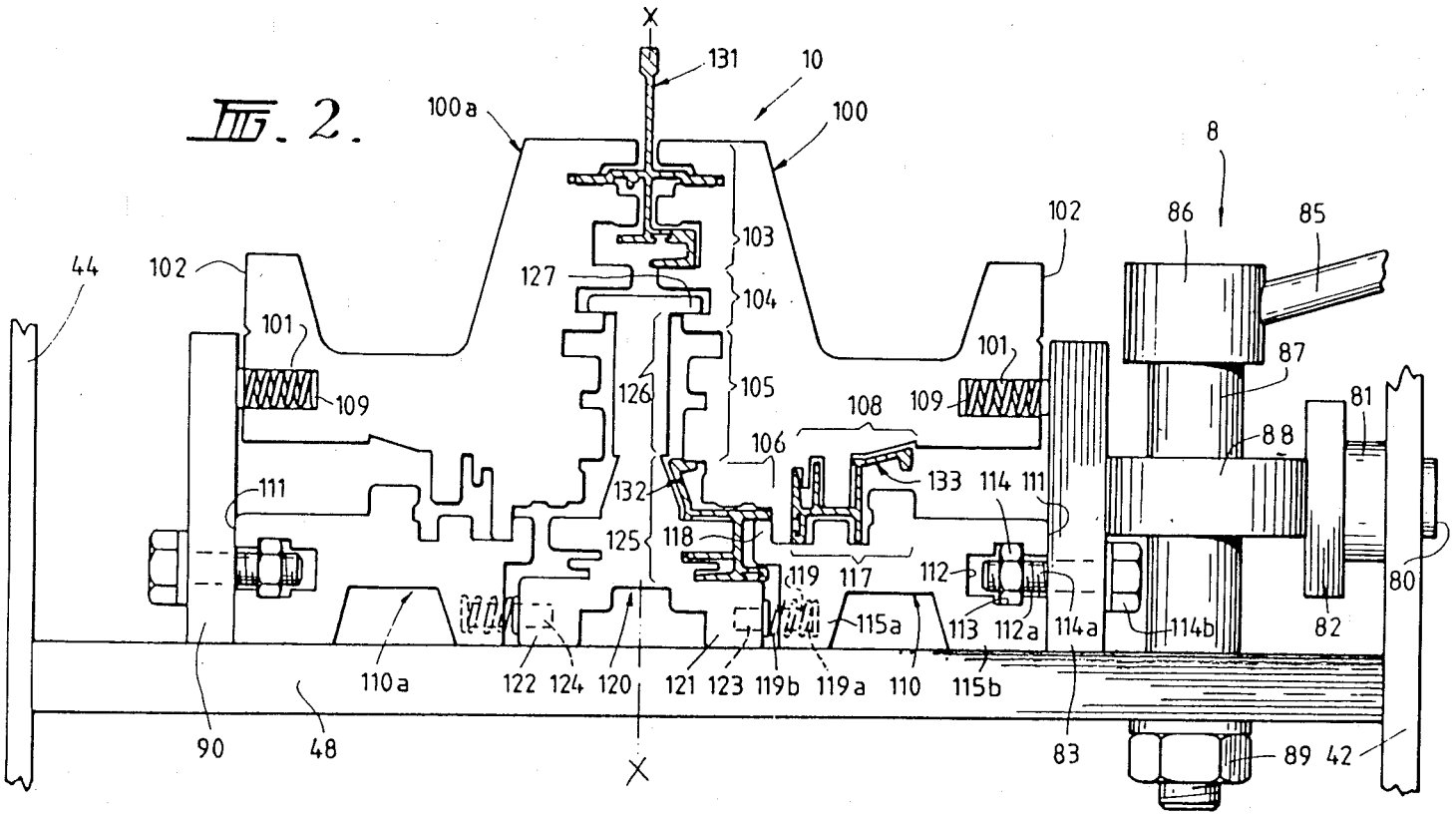
FIG. 2 is a side elevation view of the jig assembly of FIG. 1 along the lines 2 to 2 of FIG. 1.
Figure 4:
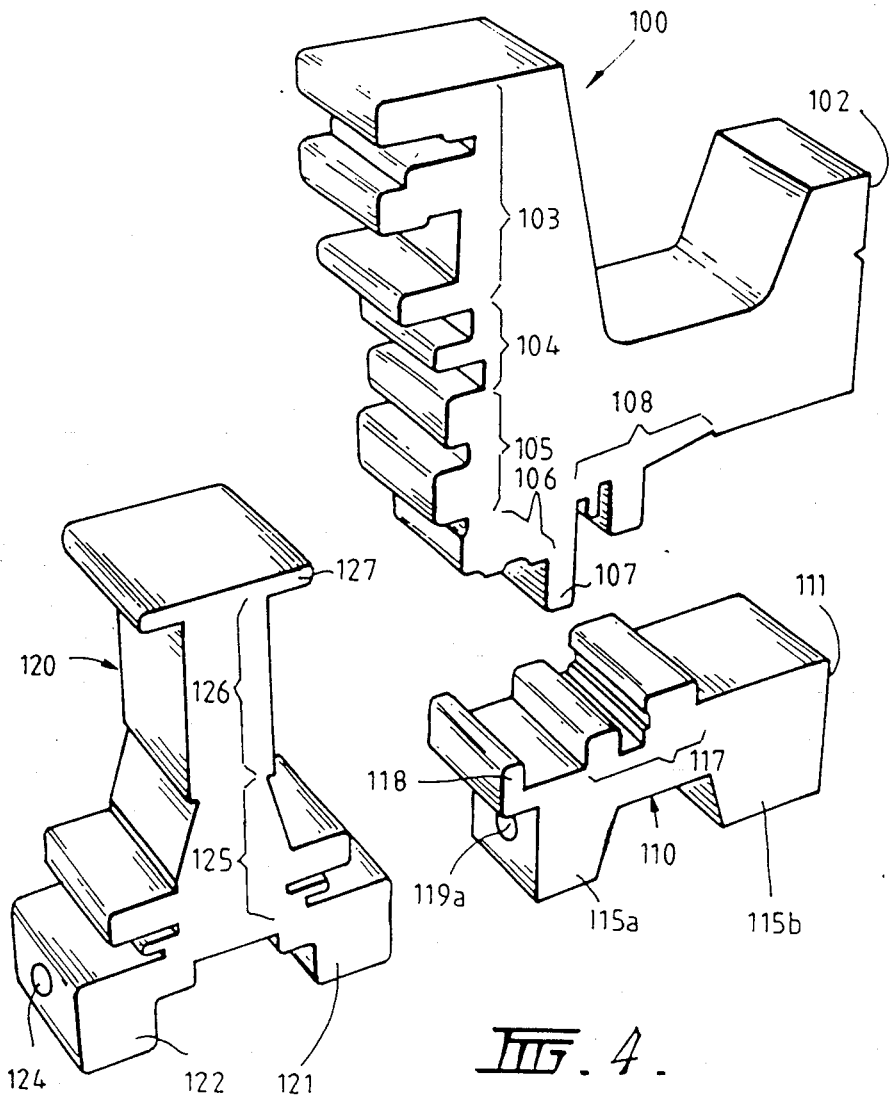
FIG. 4 is a perspective view of one form of the set of jaws showing each of the different jaw pieces comprising one set of jaws.

The jaw assembly 10, in the embodiment described, comprise 5 separate jaw pieces **100, 100*a*, 110, 110*a*, 120 which in use may be interlocked together so as to form a clamp or vice for aluminium extrusions locatable within specific portions of the jaws. With particular reference to FIGS. 2 and 4, it can be seen that the jaw pieces are arranged to be symmetrical about a central axis indicated by the line x to x of FIG. 2. The jaw assembly comprises a pair of identical first jaw pieces 100, 100*a*, a pair of identical second jaw pieces 110, 110*a*, and a single third jaw piece 120. Jaw pieces 100, 100*a* are arranged on either side of axis x—x with a mating portion of each along a central axis x—x. First jaw piece 100, comprises a backing portion 102 for location against movable clamping plate 83 in use and a highly contoured profile portion which is located in board in use against the second and third jaw pieces as shown in FIG. 2. A recess 101 is provided in backing portion 102 for receiving a dowel or similar aligning projection. In addition a spring 109 is located in backing portion 102 to assist in separating the jaw pieces when vice assembly 10** is released in use.

The highly contoured profile portion of jaw piece 100 comprises a first profile portion 103 for receiving one side of an aluminium extrusion having a first shape 131, a second profile portion 104 being a recess for receiving projection 111 of jaw piece 110 (to be described in more detail later), a third profile portion 105 for receiving one side of an aluminium extrusion having a second shape (not shown), a fourth profile portion 106 for receiving one side of one part of an aluminium extrusion having a third shape 132, a fifth profile portion 107 being a projection for engaging against a complementary projection of third jaw piece 120 (to be described in more detail later) and a sixth profile portion 108 for receiving one side of an aluminium extrusion having a fourth shape 133. Jaw piece **100*a* is identical to jaw piece 100 but is arranged in position as a mirror image to jaw piece 100 and thus its backing portion 102 bears against a fixed plate 90** in use. It is to be noted that each jaw piece holds the aluminium extrusion from one side so that the combination of two or three jaw pieces serves to clamp the extrusion securely in the jaws from all sides irrespective of the complex shape of the extrusion.

Jaw piece 110 has a backing portion 111 for bearing against movable clamping plate 83 in use. A counter bored recess having a relatively smaller diameter portion 112, 112*a* located on either side of a relatively larger portion 113 is provided in the backing portion 111 for receiving a nut 114 and bolt 114*a* combination to securely fix jaw piece 110 to clamping plate 83. Bolts 114*a* is received through an aperture in plate 83 and is secured by bolt head 114*b*.

The profiled portion of jaw piece 110 comprises a first profile portion 117 which is complementary in shape to profile portion 108 for receiving the other side of aluminium extrusion 133 so as in use to clamp aluminium extrusion 133 in place. A second profile portion 118 which is a projection for cooperatively engaging against projection 107 of jaw piece 100 described above. In use, projection 118 is located in board of and abutting with projection 107 so that when jaw piece 110 moves towards plate 83, jaw piece 100 is separated from jaw 100*a*. Movement of jaw 110 is effected by movement of plate 83 since jaw piece 110 is fixed to plate 83. The end of projection 112 in addition, forms a part of the profile portion for holding a side portion of aluminium extrusion 132 in place. Dowel 119 is located in a recess 119*b* provided in the in board edge of jaw piece 110. Spring 119*a* is located around dowel 119 and is biased to push the jaw pieces apart so that when the handle 85 of the actuating subassembly is rotated to release the jaw assembly the jaw pieces are pushed apart slightly by means of the force of the spring. Feet 115*a*, 115*b* are provided along the lower surface of jaw piece 110 to rest on base plate 4. Jaw piece 110*a* is identical to jaw piece 110 but is located as a mirror image thereof in position in the jig assembly so that backing portion 111 of jaw piece 110*a* is fixedly fastened to fixed place 90. Jaw pieces 110 and 110*a* are located on either side of central axis x—x at equidistance spaced apart intervals.

Jaw piece 120 which is located intermediate jaw pieces 100, 100*a*, 110, 110*a*, has a pair of feet 121, 122 located along its lower surface in use, to rest upon base plate 48 in use. A recess 123 is provided in foot 121 for receiving a dowel or similar aligning means therein. In use dowel 119 is received in aligned recess 123 and 119*a* to located jaw piece 110 in abutting relationship against jaw piece 120 in use. Similarly, on the other side of jaw piece 120 there is provided recess 124 in the foot 122 for receiving a dowel or similar aligning means, such as for example the same arrangement as previously described for the other side of jaw piece 120. Thus, jaw piece 120 is accurately located in position between jaw pieces 100, 100*a* in use.

The profile portion of jaw piece 120 comprises a first portion 125 for receiving the other side of aluminium extrusion 132 to clamp the extrusion in combination with portion 106 of jaw piece 100. Portion 106 is complementary in shape to the obverse shape of extrusion 132 whereas portion 125 is complementary in shape to the reverse side of extrusion 132. Second portion 126 of jaw piece 120 in combination with portion 105 forms a clamp for the metal extrusion inserted therebetween. Third portion 127 is a projection which is complementary in shape to recess 104 of jaw piece 100 and is received therein in use to locate the jaw pieces with respect to each other. Jaw pieces 120 is symmetrical about central axis x—x of FIG. 2 and is located along central axis x—x in use.

Thus, from the foregoing when handle 85 is rotated to move plate 83 away from the sides 102, 111 of jaw pieces 100, 110 respectively, springs 109, 119*b* and the like push the jaw pieces apart in combination with bolts 114*a* and projections 118, 107, 127 and the like to separate the jaw pieces sufficiently to insert and/or remove the aluminium extrusions from the assembly.

In operation, a length of aluminium extrusion of a specific profile is inserted in the jaw assembly 10 in the profile corresponding to the selected profile to the desired length. The desired length is achieved by suitable stop means located on the jig assembly in the vicinity of the machining assembly 6. The jaw assembly is clamped tightly around the aluminium extrusion and the cutters operated. Machining assembly 6 is moved sideways to cut the end of the extrusion. By judicious placement of the cutters 68 and spacers 70 all or part of the ends of the extrusion may be cut. Typically, part of the extrusion only is cut to leave legs at the extreme end of the extrusion.

Once one part of the machining has been made the jaws are released and the same extrusion is inserted into a different part of the profile, if appropriate, so that a different part of the same end of the extrusion is presented to the cutters. The machining assembly is again moved past the end of the extrusion to cut further parts from the extrusion. The profiled portions of the jaw pieces are such that one profile may be a 90° rotation about the longitudinal axis of the extrusion to another profile.

The described arrangement has been advanced by way of explanation and many modifications may be made without departing from the spirit and scope of the invention which includes every feature and combination of features hereindisclosed, particularly novel features.

Those skilled in the art will appreciate that the invention described herein is susceptible to variations and modifications other than those specifically described. It is understood that the invention includes all such variations and modifications which fall within its spirit and scope.

We claim:

1. A set of jaws comprising at least two pairs of identical jaw pieces, at least one pair being different from the other pair, the first pair of jaw pieces being arranged in abutting relationship as mirror images of each other about a central axis and the second pair of jaw pieces being arranged as mirror images of each other spaced apart from the central axis but located equidistant on either side from the central axis, said jaw pieces being movable with respect to each other between an operative position for securely holding a profiled work piece therebetween in use and a release position allowing insertion and withdrawal of the work piece between the jaw pieces in use, said jaw pieces of the first pair of jaw pieces including a first jaw piece and said jaw pieces of said second pair including a second jaw piece, said first jaw piece having a first portion for cooperatively engaging with a first portion of said second jaw piece to facilitate engagement of the two jaw pieces together into the operative position when the jaw pieces are moved together and to facilitate movement of the jaw pieces apart from each other into the release position, said jaw pieces each having a respective second portion, said second portion of said first jaw piece having a profile complementary to the profile of one side of the work piece and said second portion of said second jaw piece having a profile complementary to the reverse side of the work piece so that when the jaw pieces are in the operative position the space defined between the two respective second portions substantially corresponds to the profile of the work piece, whereby damage and distortion of a work piece inserted into the space during selective machining of the work piece is substantially avoided.

2. A set of jaws according to claim 1 in which there are at least two second portions of each jaw piece, and each of the second portions is of complementary shape to one of the side profiles of the work piece.

3. A set of jaws according to claim 1, in which the second portion of the jaw pieces correspond to at least two side profiles of the work piece.

4. A set of jaws according to claim 1, in which the fifth jaw piece is located on the central axis as a mirror image of itself and is located intermediate the other jaw pieces comprising the set.

5. A set of jaws according to claim 1 in which the first portion of each jaw piece is a flange or groove for interlockingly co-operating with a groove or flange respectively of one another jaw piece to facilitate movement of the jaw pieces together and apart.

6. A set of jaws according to claim 5, in which each jaw piece is provided with a flange and groove arrangement for interlocking co-operatively with one or more of the other jaw pieces.

7. A set of jaws according to claim 3, in which the second portions of the jaw pieces define a plurality of profiles corresponding to various profiles of the work piece.

8. A set of jaws according to claim 4 in which each of the jaw pieces are formed as an extrusion from aluminium or an aluminium-containing alloy which is capable of being extruded.

9. A set of jaws according to claim 4 in which the second portions of the jaw pieces at least have been surface treated to improve their wearing characteristics.

10. A set of jaws according to claim 4 further comprising means to facilitate their separation from each other in parallel relationship to each other to prevent any turning movement or couple being applied to one or more of the jaw pieces when separating.

11. A set of jaws according to claim 1 further comprising locating means to accurately align the respective jaw pieces with respect to each other.

12. A jig assembly comprising a set of jaws according to claim 4 in which the jaw pieces are located between operating means of a vice arrangement wherein at least one of said jaw pieces has a third portion for co-operatively engaging with respective portions of the movable vice means wherein said first portions of said respective jaw pieces co-operatively engage with each other into said operative position in response to movement of said movable vice means in one direction and said jaw pieces co-operatively move apart from each other into a release position in response to movement of said movable vice means in the opposite direction.

* * * * *